United States Patent [19]

Cox et al.

[11] 3,953,205

[45] Apr. 27, 1976

[54] PRODUCTION OF HOMOGENEOUS ALLOY ARTICLES FROM SUPERPLASTIC ALLOY PARTICLES

[75] Inventors: Arthur R. Cox, Jupiter; Gary K. Lewis, Lake Park, both of Fla.

[73] Assignee: United Technologies Corporation, Hartford, Conn.

[22] Filed: June 6, 1973

[21] Appl. No.: 367,601

[52] U.S. Cl. ..... 75/213; 75/211; 75/214; 75/225; 75/226; 148/126

[51] Int. Cl.[2] ..... B22F 3/12

[58] Field of Search ..... 75/211, 213, 200, 214, 75/226, 225; 148/126

[56] References Cited

UNITED STATES PATENTS

| | | | |
|---|---|---|---|
| 3,318,683 | 5/1967 | Foster, Jr. et al. | 75/213 X |
| 3,671,230 | 6/1972 | Smythe et al. | 75/213 |
| 3,702,791 | 11/1972 | Freche et al. | 29/420.5 X |
| 3,728,111 | 4/1973 | Stromblad et al. | 75/211 X |
| 3,775,101 | 11/1973 | Freche et al. | 75/213 |

OTHER PUBLICATIONS

Bufferd, A. S. Complex Superalloy shapes, in Pow. Met. for High Preformance Applications, Syracuse U. Press, 1972, p. 304.

Sands et al., Powder Metallurgy, George Newnes Ltd., London, 1966, pp. 24–25.

Bufferd, A. S. et al. Application Outlook for P/M Sintered parts, in Met. Progress, Apr. 1971 pp. 69–71.

*Primary Examiner*—Benjamin R. Padgett
*Assistant Examiner*—R. E. Schafer
*Attorney, Agent, or Firm*—Charles E. Sohl

[57] ABSTRACT

The constitutionally complex alloys, particularly those exhibiting good high temperature strength and prone to the development of unacceptable heterogeneity in conventional casting operations, are produced by consolidation of a cold-worked particulate material which is sized to preclude the development thereon, in the time span at temperature used in consolidation, of undesirable surface phases such as carbides which inhibit particulate bonding.

6 Claims, No Drawings

PRODUCTION OF HOMOGENEOUS ALLOY ARTICLES FROM SUPERPLASTIC ALLOY PARTICLES

BACKGROUND OF THE INVENTION

The present invention relates in general to alloy processing methods. It contemplates a process for preparing billet stock or other useful articles by the consolidation of particulate material and is particularly applicable to the preparation of sound, homogeneous components from the constitutionally complex alloys.

In the gas turbine engine industry the stringent strength and temperature demands made of the engine alloys, particularly in recent years, has placed this industry in the forefront of high temperature alloy development. Many of the advanced materials may be classified as constitutionally complex, i.e., they contain a large number of different elemental constituents all of which serve a definite advantageous purpose when properly combined and utilized. However, the highly alloyed nature of many of these materials has seriously complicated their production in usable form.

The production and evaluation of these alloys on a laboratory scale is often reproduced, if at all, only with difficulty on the production line. In the patent to Moore et al. U.S. Pat. No. 3,669,180, for example, it was pointed out that a lack of metallurgical homogeneity in actual wrought gas turbine engine hardware has led not only to a reduction in mechanical properties but also to a lack of predictability of such properties because of a broad scatter of sizes, types and locations of microstructural heterogeneity. This heterogeneity may in many cases be traced directly to a fault in the forging stock itself. For example, the slower solidification rate of a large ingot may provide sufficient time for undesirable localized constituent segregation which is not evident in smaller ingots wherein solidification has been more rapid.

In an effort to minimize the problems of heterogeneity and the resulting property scatter to permit a more reasonable utilization of the properties of which the idealized composition is capable of providing, resort has recently been made to a powder metallurgy approach to billet production. The rationale here is, of course, that if the individual powder particles are homogeneous, a billet formed of such powders should also be homogeneous. Unfortunately, such is not always the case, and the powder metallurgy approach has generated problems of its own.

Alloy powders may be generated by any one of several techniques. In general, however, two basic approaches are involved. In the first, very fine spheroids of the molten alloy are formed, as by expulsion of the melt through a nozzle, and quickly frozen, as illustrated by the technique of Gow in U.S. Pat. No. 2,439,772. In the second, a solidified ingot of the appropriate composition is comminuted to fine powder as suggested by, for example, Williams et al. U.S. Pat. No. 3,554,740 or Voightlander et al. U.S. Pat. No. 1,800,122.

Fundamentally, the powder metallurgy approach is inherently expensive and requires meticulous care in processing. Furthermore, even with the most careful attention to the processing details, problems of contamination and resistance of the powders to consolidation into a sound billet, as well as other problems associated with the inherent reactivity of fine powders, have often been evidenced in powder metallurgy products.

The overall result is that an urgent need still exists for a process that cannot only produce a satisfactory product from the constitutionally complex alloys but also one that will do so economically.

SUMMARY OF THE INVENTION

It is an object of the present invention to provide means for reproducibly and inexpensively generating sound, homogeneous alloy articles of any size, but particularly in the larger sizes, from the constitutionally complex alloys.

In accordance with the invention, alloy particulate mechanically removed from alloy stock of the appropriate composition and sized to provide a particulate diffusion distance sufficiently large to preclude the loss of interstitial alloying additions through the generation of undesirable surface species in the time span at temperature required for consolidation, but small enough to assure homogeneity and the attainment of substantially full density in consolidation, is compacted in the absence of a contaminating atmosphere, preferably in vacuum.

DESCRIPTION OF THE PREFERRED EMBODIMENTS

As previously discussed, two of the major problems associated with the production of articles from the constitutionally complex alloys by conventional powder metallurgy techniques are a susceptibility of the fine powders to contamination and the resistance of the powders to consolidation. Further, the surface reactivity associated with powders can result in such property disadvantages as notch embrittlement. All of these problems are, at least to some extent, usually associated with particle size and shape.

Fine powders of the type used in the typical powder metallurgy approach have an inherently high surface area to volume ratio. This high surface/volume property provides a natural propensity for the adsorption and retention of detrimentally large quantities of gases at the surfaces which can either become entrapped in the consolidated article or react with the metal substrate to produce compounds or phases resistant to the particle to particle bonding mechanism required in consolidation. In addition, fine powders pack to such high densities in a containment vessel that even hard vacuums and long term degassing procedures are ineffective in ridding the powders of detrimental amounts of the adsorbed gases and residual atmosphere from the bulk system.

It has been discovered that particle size plays another important role as well. In some alloys and particularly in the highly alloyed materials, diffusion controlled reactions are evident. These reactions in fine powders frequently lead to the development of surface compounds or phases by an internal combination of elements leading to particle bonding resistance. Certain of these are the carbides and the intermetallic phases which are advantageous in developing the alloy properties per se. With fine powders the diffusion distances are so small that the surface effects, within the time span required at temperature required for complete processing, are sufficiently large to make the surface reactions unavoidable. The net result is not only a probable resistance to the requisite bonding but also a frequent inability to subsequently heat treat the consolidated article for the maximization of strength or other properties.

Another characteristic to be considered is that of the actual powders themselves. For example, powders produced directly from the melt by an atomization/freezing procedure, tend to display properties similar to those of castings as opposed to wrought particulate. Very frequently also, the particles as purchased have displayed the presence of an undesirable surface phase and, accordingly, are resistant to consolidation despite careful control in subsequent processing. Such powders must be distinguished from the cold-worked particulate of the present invention.

From a consolidation viewpoint it is generally considered that the smaller the particle size the better where maximum density is required. This is typically the case in the usual powder metallurgy approach. Thus, only in those cases, such as indicated in Tormyn U.S. Pat. No. 2,287,951 where less than optimum properties are satisfactory, have particles such as chips been employed in the production of useful embodiments. In this sense, the present invention leads away from the usual practice.

In terms of the upper limit of particulate size in the present invention, two factors assume principal roles. First, the particle size must be small enough to insure homogeneity and to provide an ability in equipment of reasonable size in the circumstances to achieve full density. It has been found that cold-worked particulate matter is required. In the most preferred processing, sufficient cold work is built into the individual particles so that at the high temperatures used in consolidation a condition of superplasticity is achieved in the particles thereby permitting a high degree of plastic flow and the ready elimination of any voids with reasonable pressures. This condition also promotes the interparticle bonding required for consolidation by furnishing sufficient particle ductility to assure complete bonding throughout the article. Thus, the maximum particle size is determined by the degree of ductility attainable in the particles, the nature of the equipment available and to the nature of the shape being produced insofar as it determines how much metal movement is required.

It is of course well known that other forms of contamination other than surface reaction products adversely affect consolidation. For this reason it is axiomatic that absolute particle cleanliness in terms of the elimination of oils, greases and foreign substances must be insured.

The increase in particle size has another synergistic effect in processing. Not only is the surface/volume ratio reduced minimizing the degree of gas adsorption but the initial packing volume of the particles is such that degassing may readily be accomplished in reasonable times. It is of course essential that even inert gases be substantially removed from the particles before consolidation to prevent void formation incident to gas occlusion. With fine powders the gas volume is so high and the initial packing density so large that degassing of even the inert gases is virtually impossible.

EXAMPLES

Chips of IN 100 alloy of the type disclosed in the patent to Bieber U.S. Pat. No. 3,061,426 were obtained by mechanical means. This alloy is a nickel-base material of the $\gamma$–$\gamma'$ type which is used extensively in gas turbine engine applications.

The chip size was selected rather randomly, the principal requirement being that the particulate surface area to volume ratio be at least one order of magnitude less than that of powder. After several cutting trials, it was found that a size in the order of 1 × 1 × 3 mm. was easily obtained and about 120 pounds of these chips were produced. The overall processing included machining, cleaning, annealing, compaction and extrusion, with annealing, compaction and extrusion being performed in vacuum, all other steps being performed in the ambient environment.

All chip material was turned from vacuum melted 2¾ inch ingot after the diameter was machined 0.125 inch to clean off the contaminated outer layer. The first billet was machined with air blown on the work area for cooling in order to avoid possible contamination from the coolant and lubricant. The second two billets were machined using standard water soluble cutting fluids which were later removed. Magnetic tool bits (tungsten-cobalt carbide, cobalt binder) were used for cutting to allow later selective removal by magnetic means.

The chips were rinsed in trichloroethylene followed by freon and drying at 200°F. Tramp element analysis indicated no abnormal impurities from cleaning. Further cleaning was employed to remove small pieces of tool bit that were collected with the chips because of tool wear. The chips were first screened and all minus 20 mesh material discarded and magnetic separation was used to remove any larger fragments.

As so processed, the chips exhibited severe cold work and annealing studies were undertaken in order to determine whether any advantage could be achieved by recrystallizing prior to compaction into an extrusion container. It was found that recrystallization could readily be induced at temperatures above approximately 1,850°F. On the basis of a 2 hour heat treatment cycle, almost complete crystallization occurred at 1,900°F. with grain growth commencing at 2,000°F. A desirable superplastic state was apparent at the lower annealing temperatures. Based on this work the first billet used chips annealed at 1,900°F. prior to compaction. The other two billets used chips sealed in the cold work condition and allowed to recrystallize during a heat soak prior to hot compaction.

The chips were loaded into 6 inch diameter stainless steel containers. After filling the first two billets were densified cold by pressing until peripheral growth of the can was observed, using a force of about 370 tons. The third billet was processed with loose particulate resulting in billet densities of about 50–55 percent for the first two and about 30–35 percent for the third.

All three billets were then outgassed, the first for three hours at ambient temperature and 10 microns absolute pressure. The second was held at 0.5 micron pressure for 12 hours at ambient temperature followed by heating at this same pressure to 1,850°F. The number three billet was processed in the same manner except that the long dwell at ambient temperature was eliminated. After completion of the outgassing sequence, the containers were sealed in vacuum.

The sealed containers were then all extruded at a 6/1 extrusion ratio, the first at 2,000°F. and the latter two at 1950°F. The first two billets compacted and extruded with no defects. The third billet showed extensive can folding due to the initial high reduction required for compaction. However, this did not impede bonding or densification.

The microstructure of each billet was evaluated after extrusion and after subsequent standard heat treatment. In all cases bonding was achieved, recrystallization complete, and the uniformity of observable phases good. However, it was evident that under conditions of cold compaction and cold evacuation, extensive reaction of the metal with the residual environment had taken place. With cold compaction and hot evacuation, the same reactivity had occurred but to a lesser degree. Under conditions involving the hot evacuation of loose particulate, surface reaction has been almost entirely eliminated. The reaction products referred to are those associated with oxygen and nitrogen and do not reflect a carbide phenomena which has been observed when high temperature extrusion is performed without prior hot compaction.

It is apparent that cold or hot evacuation of compacted particulate is not effective and only under conditions of relative surface freedom is adequate outgassing obtained. This is attributable to two phenomena: (1) residual gas cannot be removed from a relatively high density mass because of the limited cross-sectional area available for gas release and (2) gases adsorbed on the particulate are in high enough concentrations that they must be desorbed and ejected prior to bonding.

Samples were taken from the various extrusions and from forgings made utilizing the extrusions. Residual superplasticity was observed in the extrusions, the second being superior to the first in this regard. The poorer values obtained with the first billet are considered to be directly related to the higher degree of contamination therein. Tensile properties were fairly consistent for all samples although billet one properties were somewhat lower and attributable to the higher contamination level. Smooth rupture specimens were tested at 1,350°F. and 100,000 p.s.i. All specimens exceeded the demanding specification requirements but the two billets which were hot outgassed had lives up to 70 percent greater than that which was outgassed cold.

The most significant feature resulted from the notch rupture data. For the number of billet, repetitive tests showed considerable scatter and 3 specimens in ten failed to exceed specification requirements of 23 hours. For the second and third billets notch strengthening occurred in every test, particularly for the third which displayed a notch life to smooth life ratio of 3.36 as extruded. Thus, in billet number one, notch life was unpredictable although this billet was clean by powder metallurgy standards. In billet two notch life surpassed smooth and in billet three, when surface reactions were nil, an absolute condition of notch strengthening was realized. Similar results were evident after full heat treatment.

Actual gas turbine engine discs were made using billet stock prepared in the above described preferred manner. In test they were shown to be both better and cheaper than the discs fabricated from the best powder product now available.

Thus, in the nickel-base alloy system the process is undertaken under conditions leading to recrystallization without substantial grain growth; removal of the residual environment so that spurious surface reactions cannot occur in sufficient quantity to be detrimental; using control of the time at bonding temperature such that surface reactions are inhibited with bonding under conditions providing grain growth across the interparticle interface by a combination of both stress relief and an increase in internal energy.

Particle size is selected large enough, usually in excess of about 0.003 inch to prevent the above mentioned adverse surface reactions in the time at temperature allocated in processing, and usually small enough, for essentially practical reasons, to produce density greater than about 15 percent of theoretical. In the case of the nickel-base alloys particle sizes less than about 0.006 inch generally become impractical not necessarily because of unsuitability to the present processing but because subsequent heat treatability may be compromised.

The temperatures utilized in processing should be high enough to insure the availability of sufficient energy to provide diffusion across the interparticle interfaces and it is very desirable that they be above the recrystallization temperature but below the secondary phase solvus or $\gamma$-$\beta$ trans (for the titanium alloys).

The above processing, modified to accommodate the different temperature requirements, has also been applied to the titanium alloys. In the case of titanium, concern with the generation of surface reactions from an internal diffusion mechanism is minimal. Thus, in this regard, minimum particle size is of less concern with titanium.

Processing similar to that described for the nickel-base alloys was also used to produce a gully densified product from reclaimed titanium alloy scrap. The starting material was particulate formed by the comminution of scrap machine turnings cleaned by the use of solvents, flotation and magnetic separation followed by outgassing and compaction to a fully dense product.

Ti-6Al-4V alloy scrap, collected from machine shop scrap barrels, was selected at random for initial evaluation. The scrap size varied dimensionally generally within the ranges of 0.125 – 0.250 inch in width, 0.005 – 0.020 inch in thickness and 0.250 – 18 inches in length, and had a bulk density of 5–15 5percent.

All scrap was checked for oxygen content against the AMS 4928 specification requiring less than 2,000 parts per million. Cleaning involved several operations designed to remove various contaminants. Initially, large items such as cloth, paper, etc., were manually removed and water flotation was utilized to float off remaining contaminants as well as to remove water soluble contaminants. Rinsing in demineralized water further removed water soluble compounds and was followed by drying, degreasing in acetone and freon followed by additional drying to vaporize any remaining acetone and freon.

Comminution of the scrap was accomplished both by mechanical shearing and by a hydride and rolling process. Mechanical shearing consisted of dropping the scrap from a hopper onto a shearing surface where it was struck by high speed rotating blades, providing an as-poured bulk density 25–30 percent of theoretical. This material was then passed through a magnetic separator to remove magnetic contamination, specifically tool bit pieces acquired during machining operations.

When hydriding was conducted, hydrogen was passed through the chips at 800°–900°F. producing a very brittle $TiH_2$ compound upon cooling. After magnetic separation, the hydrided chips were dropped between rolls, only a minimal force being required to produce an as-poured density greater than 50 percent.

The particulate, either hydrided or mechanically sheared was then outgassed, densified and forged in vacuum. If previously hydrided, the hydrogen was removed by taking the material above the $TiH_2$ stabilization temperature (800°–900°F.) and (1,600°–1,750°F.) while maintaining a vacuum on the system. Adsorbed gases were also released as the material was brought to the forging temperature. After temperature stabilization and gas removal the chips were upset and pressed isothermally to a disc 0.5 inch thick by 7 inches diameter.

Metallurgical evaluation revealed complete particle bonding, full density and no evidence of prior particle boundaries. The $\gamma$–$\beta$ structure was homogeneous and responsive to heat treatment. Mechanical properties of the material, whether hydrided or sheared, surpassed 600°F. tensile specifications for gas turbine engine applications and AMS 4,928 specifications.

The process appears applicable to metal particulate generally, with, of course, appropriate attention to temperatures suitable for the particular alloy system involved. Its principal utility, however, is with respect to the constitutionally complex alloys characterized by high surface reactivity and/or susceptible to impermissible segregation in large alloy castings. Thus, the process is particularly applicable to alloys such as IN 100, Waspaloy, Astroloy, Rene 41, AF2-1DA, Inconel 718, titanium 6-4, titanium 6-2-4-2, and titanium 6-2-4-6. Representative processing parameters for these materials would be:

| | | |
|---|---|---|
| Astroloy | Consolidation temperature | 1800–2025°F. |
| IN 100 | " | 1800–2100°F. |
| Waspaloy | " | 1750–1800°F. |
| Ti 6-4 | " | 1300–1750°F. |
| Ti 6-2-4-6 | " | 1300–1700°F. |
| Ti 8-1-1 | " | 1300–1850°F. |

From the foregoing it will be seen that the fabrication procedures herein described provide means for the economical and reproducible fabrication of homogeneous articles from the constitutionally complex alloys. In addition, the articles themselves display properties never before achievable at least on a production scale. Although the invention has been described in detail in connection with certain preferred embodiments and examples, departures may be made therefrom within the scope of the appended claims without departure from the principles of the invention and without sacrificing its chief advantages.

We claim:

1. A process for reproducibly forming homogeneous articles from the constitutionally complex alloys which comprises:

providing the alloys in the form of clean, cold-worked particulate material, with the degree of cold work in the particles being sufficient to cause recrystallization and a condition of superplasticity when the alloy is heated above its recrystallization temperature, the individual particles being substantially homogeneous in composition, having an effective particle size exceeding about 0.003 inch, and providing a density of at least about 15 percent of the theoretical alloy density;

prior to extensive compaction, outgassing the particulate material in vacuum at high temperature, removing substantially all adsorbed and occluded gases therefrom;

prior to extensive compaction, heating the particulate material to a temperature sufficient to cause recrystallization and a condition of superplasticity;

compacting the degasified superplastic particulate material in vacuum at a temperature sufficient to provide interparticle bonding and further compacting the material to provide a unitary article of full theoretical density; and with the time at temperature prior to full compaction being confined to a duration less than that required for the formation, by an internal diffusion mechanism, of surface species on the particulate resistant to interparticle metallurgical bonding.

2. A process for reproducibly forming homogeneous articles from the constitutionally complex nickel-base superalloys prone to compositional segregation which comprises:

mechanically reducing homogeneous superalloy stock to chips having an effective particle size exceeding about 0.003 inch and a density of at least about 15 percent of the theoretical alloy density to provide cold worked chips which will recrystallize, and provide a condition of superplasticity, when heated above its recrystallization temperature;

cleaning the chips of grease and extraneous foreign matter;

prior to extensive compaction, outgassing the chips in vacuum through the range of ambient temperature to about 1,500°–1,900°F to remove adsorbed and occluded gases therefrom, while maintaining the vacuum environment compacting the chips at a temperature, where recrystallization occurs so that the chips are superplastic, to provide interparticle bonding and further compacting the chips to provide a unitary article of full theoretical density;

the time at temperature during outgassing and heating prior to full compaction being confined to a duration of less than that required for the formation, by an internal diffusion mechanism, of an amount of deleterious species on the chip surface sufficient to interfere with interparticle metallurgical bonding.

3. The process according to claim 2 wherein:

the time at temperature during outgassing and heating prior to full compaction does not exceed about 6 hours.

4. The process according to claim 3 wherein:

outgassing is conducted at a vacuum better than about 1.0 micron.

5. The process according to claim 2 wherein:

the final compaction is conducted by sealing the degasified chips in vacuum in a protective can;

extruding the can to fully densify the chips;

and subsequently removing the can.

6. The process according to claim 2 wherein:

the chips are compacted to less than full density in a protective can which is sealed;

extruding the can to fully densify the chips;

and subsequently removing the can.

* * * * *